United States Patent [19]

Garrott

[11] Patent Number: 4,613,104

[45] Date of Patent: Sep. 23, 1986

[54] DEMOUNTABLE COLLAPSIBLE TRASH BAG SUPPORT

[76] Inventor: Isaac Garrott, 1668 E. Alvin Ave., Santa Maria, Calif. 93454

[21] Appl. No.: 669,011

[22] Filed: Nov. 7, 1984

[51] Int. Cl.[4] ..... B65B 67/12

[52] U.S. Cl. ..... 248/97; 248/175

[58] Field of Search ..... 248/97–101, 248/165, 175, 95

[56] References Cited

U.S. PATENT DOCUMENTS

| | | | |
|---|---|---|---|
| 1,763,419 | 6/1930 | Crossmore | 248/175 |
| 3,374,976 | 3/1968 | Kurlander | 248/97 |
| 3,502,291 | 3/1970 | Ackerman | 248/164 |
| 3,595,509 | 7/1971 | Gilmoure | 248/175 |
| 3,659,816 | 5/1972 | Wilson | 248/175 |
| 3,682,421 | 8/1972 | Spiegel | 248/165 |
| 4,006,928 | 2/1977 | Beugin | 248/99 |
| 4,398,689 | 8/1983 | Prader | 248/99 |

FOREIGN PATENT DOCUMENTS

| | | | |
|---|---|---|---|
| 2549718 | 12/1977 | Fed. Rep. of Germany | 248/165 |

*Primary Examiner*—Reinaldo P. Machado
*Assistant Examiner*—Alvin Chin-Shue
*Attorney, Agent, or Firm*—Sellers and Brace

[57] ABSTRACT

Provided by this invention is a lightweight demountable folding trash bag support suitable for supporting plastic bags and the like with the bottom thereof resting against the ground or floor and having components thereof held detachably assembled without need for tools. When disassembled the components are compactly packagable for storage and shipment by mail or the like.

7 Claims, 5 Drawing Figures

DEMOUNTABLE COLLAPSIBLE TRASH BAG SUPPORT

This invention relates to bag supports, and more particularly to a unique demountable folding support for plastic bags requiring no tools for its assembly or disassembly and compactly packageable for shipment through the mails.

BACKGROUND OF THE INVENTION

Various proposals have been made heretofore for collapsible supports for various applications and including in particular supports for flexible bags while being filled with loose materials. Examples of these and the classification of the same in the classified files of the United States Patent Office include LeBourgois, U.S. Pat. No. 930,394 (248-166); Goodwin, U.S. Pat. No. 1,653,764 (248-157); Ackerman, U.S. Pat. No. 3,502,291 (248-164); Wilson, U.S. Pat. No. 3,659,816 (248-97); Gilbert, U.S. Pat. No. 3,893,648 (248-150); Walker, U.S. Pat. No. 4,138,520 (248-97); Beugin, U.S. Pat. No. 4,006,928 (248-99). The supports of both Wilson and Walker are foldable and the principal components can be detached from one another without the aid of tools but neither has any provision for holding the two folding components rigidly extended, nor can the principal components be separated from compact packaging and shipment. The Beugin device is simply a frame insertable within the open end of a bag and effective to hold it in open position while being used as a scoop to gather loose material. The other prior patents are merely of passing interest and fail to disclose important features of the present invention.

SUMMARY OF THE INVENTION

Provided by this invention is an exceedingly simple lightweight self-supporting support for plastic trash bags, the principal parts of which are formed of heavy gauge wire designed to fold compactly between periods of use and readily separable without need for tools into smaller portions for compact shipment through mail facilities. The main body comprises two rectangular frames the upright longer sides of which are pivotally clipped together by a split ring keeper and the shorter sides of which are held adjustably and separably interconnected by snug-fitting elastomeric sleeves. The main frames are held regidly in their extended position by one and preferably by two strut members having one end swivelly connected to a frame member and the other end provided with a latching hook.

In view of the foregoing it is a primary object of this invention to provide an improved low-cost, lightweight demountable folding bag support.

Another object of the invention is the provision of a folding demountable bag support for supporting a trash bag in an upright position with the weight of its contents supported by the ground or other support, and incorporating means for holding the folding support firmly extended while in use.

Another object of the invention is the provision of a folding bag support formed of readily demountable components which can be assembled and disassembled without need for tools.

Another object of the invention is the provision of a folding demountable trash bag support formed of lightweight wire components the longer ones of which are held pivotally and permanently assembly and other portions of which are held separably assembled by coupling sleeves of elastomeric material.

These and other more specific objects will appear upon reading the following specification and claims and upon considering in connection therewith that attached drawing to which they relate.

Referring now to the drawing in which a preferred embodiment of the invention is illustrated:

FIG. 2 is a fragmentary view on an enlarged scale taken along line 3—3 on FIG. 1;

Figure 1:
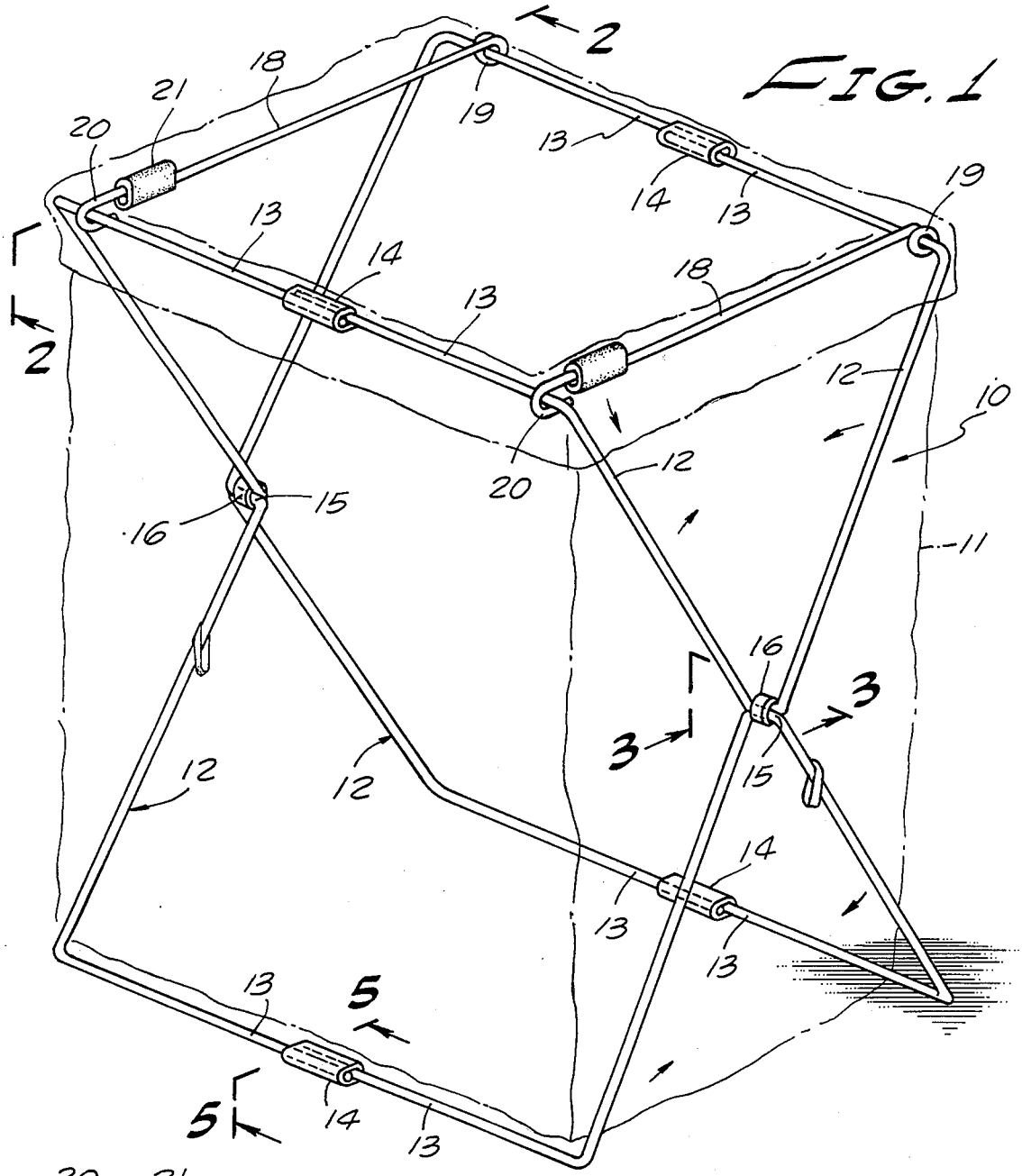
FIG. 1 is a perspective view of a preferred embodiment of the invention shown locked in assembled position and indicating by dot and dash lines a bag assembled thereto.

Referring initially more particularly to FIG. 1, there is shown one preferred embodiment of the present invention, designated generally 10, shown supporting a flexible bag 11 with its open upper end overturned about the top of the support. The main body of the support comprises two identical rectangular frame members 12, 12. Each frame member includes 2 identical U-shaped portions having the overlapped ends of their legs 13, 13 held firmly but separably and adjustably assembled by lengths of snug-fitting elastomeric sleeves 14. Legs 13, 13 lie in horizontal planes when support 10 is in use. The vertical portions of the frame members interconnecting legs 13, 13 include a short dogleg portion 15. The adjacent pairs of doglegs 15 are held pivotally and permanently assembled by a split ring keeper 16 loosely clamped thereabout at the time of manufacture.

The height of the expanded bag support 10 is substantially less than the bag 11 to be used therewith. This permits an ample portion of the open end of the bag to be overlapped outwardly about the upper perimeter of the support with the bottom of the bag supported on the ground or other supporting surface. Accordingly, the bag and its contents are primarily resting on the ground thereby avoiding the need for clips or other retaining members applied about the peirmeter of the open end of the bag. However, it will be understood that one or more clips, resilient bands or other keeper means may be applied to the overturned top of the bag if desired.

Figure 2:
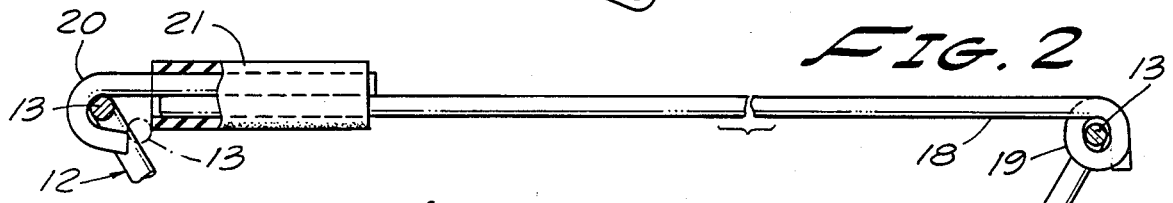
FIG. 2 is a fragmentary cross sectional view on an enlarged scale taken along line 2—2 on FIG. 1.
Figure 3:
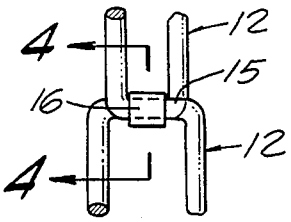
Figure 4:
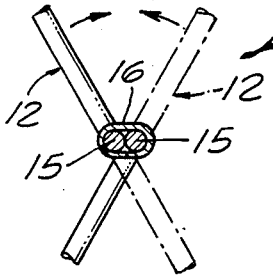
FIG. 4 is a cross sectional view taken along line 4—4 on FIG. 3.
Figure 5:
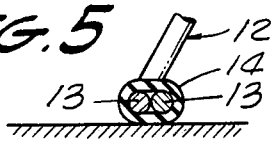
FIG. 5 is a cross sectional view on an enlarged scale taken along line 5—5 on FIG. 1.

An important feature of the invention is the provision of folding strut members 18, 18 having one end loosely curled at 19 about leg members 13, 13 of one of the U-shaped frame members. The other end of strut 18 may be provided with a latching hook engageable over the legs 13, 13 of the other frame member 12. As herein shown, latching hooks 20 comprise a J-shaped member having the leg thereof overlapping the free end of strut member 18 and held firmly and adjustably assembled thereto by elastomeric sleeves 21. As is best shown in FIG. 2, the free end of hook 20 is preferably spaced from the adjacent end of sleeve 21 by a distance somewhat less than the diameter of leg 13. By this technique, the hook members cannot become disengaged except by a deliberately applied force sufficient to deform the adjacent end of sleeve 21. This avoids the accidental or unintentional disengagement of the struts from the frame members during the use of the support both while a bag is being filled or emptied or while the support and an attached bag is being used as a scoop to collect leaves or loose trash into the bag.

The strong and snugly fitting elastomeric sleeves 14 permit the frame members to be disassembled and compactly packaged in folded condition while in inventory, shipment and prior to sale. Thereafter, the purchaser readily assembles the halves of the two frame members by inserting the ends of legs 13 through the opposite ends of sleeves 14 to the extent accommodating the size of a particular trash bag, it being apparent that greater or lesser portion of legs 13 can be secured in overlapping relation within sleeves 14 to accommodate bags with different size open ends. Preferably, the opposite ends of the frame members are adjusted so that the overturned end of a conventional standard trash or other bag has a reasonably snug fit when draped and overturned about the upper end of an expanded bag support. If desired, clothes pins, clips, rubber bands or other means may be assembled over the overturned end of the bag, but many users find this expedient unnecessary. If the user wishes to employ the support as a scoop while gathering leaves, he simply grasps one portion of the upper perimeter of the support and rotates it until the other side is in contact with the floor or ground while the loose material is being scooped into the bag.

When not in use, strut members 18 are unclipped and folded against one of the frame members to which it may be secured by a rubber band or the like. The two frame members are then pivoted together so that the support can be stored in a fully collapsed position.

Frame members 12, 12 are preferably formed from tempered resilient wire stock enabling them to withstand abusive handling and use without permanent deformation. This property taken with the elasticity of the coupling sleeves 14 permits the longer sides of the frame top to flex very substantially in response to an applied force and to resume its former shape as soon as the force is removed. For example, if a loaded container is rested against one side of the frame while being emptied into bag 11, the adjacent sleeve 14 and legs 13, 13 are deformed momentarily and then resume their normal configuration as the load is removed.

While the particular demountable collapsible trash bag support herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A folding bag support comprising:

a pair of rectangular wire frames having longer and shorter sides each having similar dogleg portions having a substantially horizontal portion at the midlength of the two longer sides offsetting an upper and lower portion thereof;

split ring clip means embracing said horizontal portion of the adjacent pairs of said dogleg portions to hold said frames pivotally assembled; and at least one tie member having a first end thereof pivotally connected to a shorter side of one of said frames and the second end thereof detachably engageable with the adjacent shorter side of the other said frames, and said tie member cooperating to hold said frames pivoted apart to provide a rigid support for a bag with the open end thereof overturned about the uppermost pair of the shorter sides of said frames.

2. A folding bag support as defined in claim 1 characterized in that the shorter sides of said frames are severed with the severed ends of each overlapping one another and held assembled by a snugly encircling length of elastomeric tubing.

3. A folding bag support as defined in claim 1 characterized in that the assembled height of said support is substantially less than the length of a bag mounted thereon with its open end overturned about the upper end of said support whereby the bottom of the bag rests against the ground.

4. A folding bag supported as defined in claim 1 characterized in that said tie member includes a U-shaped hook means at the second end thereof detachably engageable with the adjacent shorter side of the other of said frames to hold said frames rigidly expanded in a bag-supporting position.

5. A folding bag support as defined in claim 4 characterized in that said U-shaped hook means includes a sleeve of elastomeric material frictionally assembled over said tie members with one end thereof closely spaced from the free end of the associated one of said hook means and operable to resist disengagement of said hook means from said shorter side of one of said frames.

6. A folding bag support as defined in claim 2 characterized in that the shorter sides of said frames are severed generally in the mid portions thereof whereby said pivotally connected pair of frames are separably interconnected by said lengths of elastomeric tubing to enable the same to be disassembled and superimposed against one another for compact packaging.

7. A folding bag support as defined in claim 1 characterized in that said tie member includes means for holding said second end thereof detachably and captively assembled to the adjacent shorter side of the other of said frames whereby said support and a bag having its open end overturned about the upper end of said support can be rotated onto one side thereof and employed as a scoop to expedite the filling of the bag with loose material.

* * * * *